United States Patent [19]

Victoor et al.

[11] Patent Number: 4,860,800

[45] Date of Patent: Aug. 29, 1989

[54] WEFT CARRYING GRIPPER FOR WEAVING LOOMS

[75] Inventors: Johnny Victoor, Langemark; Lucien Coopman, Zonnebeke; Denis Moeneclaey, Westrozebeke-Staden, all of Belgium

[73] Assignee: Picanol N.V., Ieper, Belgium

[21] Appl. No.: 56,723

[22] Filed: Jun. 2, 1987

[30] Foreign Application Priority Data

Jun. 3, 1986 [BE] Belgium ..... 2/60987

[51] Int. Cl.[4] ..... D03D 47/20

[52] U.S. Cl. ..... 139/448

[58] Field of Search ..... 139/448, 447

[56] References Cited

U.S. PATENT DOCUMENTS 4,271,873 6/1981 Genini ..... 139/448

4,417,606 11/1983 Corain ..... 139/448

*Primary Examiner*—Henry S. Jaudon

*Attorney, Agent, or Firm*—Bacon & Thomas

[57] ABSTRACT

A weft carrying gripper is configured to have a small, open sided profile and includes a weft thread gripping jaw portion that is pivotally mounted by a broad hinge pin in lever fashion to the body of the gripper such that the weft clamping element tends to tighten in the clamp closing direction if inadvertent contact occurs between the weft carrying gripper and the weft drawing gripper. Various clamping and thread guiding arrangements are described.

9 Claims, 4 Drawing Sheets

WEFT CARRYING GRIPPER FOR WEAVING LOOMS

BACKGROUND OF THE INVENTION

The present invention concerns a weft carrying gripper for gripper weaving looms, more specifically a gripper carring the weft threads from the insertion side of the shed to the halfway point of the shed or further.

As is already known, the weft thread is carried over the other half of the shed by means of a drawing gripper which pulls the weft thread completely through the shed to the opposite side.

Known carrying grippers essentially comprise a gripper body that is rigidly connected to the strap or tape and includes a weft clamping device for clamping the weft threads during the transportation through the shed. Such a gripper, for example, is described in the Belgian Patent No. 902,141 owned by the assignee of this application, and the Swiss Patent No. 490544.

By using a separate clamping device, carrying grippers of the prior art have the disadvantage that they are relatively bulky, complicated and heavy, so that the maximum weaving speed is limited for technical reasons. It is indeed hardly possible to reduce the weight of such grippers because reduction of size also results in reduction of the size of the clamping device, so that clamping force control is reduced. At larger weaving speeds, however, it is necessary to have better control over and stable and fine adjustment of the clamping force.

Accordingly, any further reduction of the size of such carrying grippers in order to reduce their weight does not yield any more advantage after a given stage of reduction.

If such carrying grippers are made relatively small, these also offer the disadvantages that the fastening of the clamping device, more specifically the hingepoint of the clamping lever, becomes very weak while the hinge becomes prone to wear. Moreover, a small hinge is too weak to resist twisting that occurs in most cases when the clamping device is opened, because the pressure point for actuating the clamping lever is located eccentrically of the hinge plane.

BRIEF SUMMARY OF THE INVENTION

The present invention is concerned with a carrying gripper having a small weight and size, while retaining the full clamping device, the support for the clamping device and the control level used to this end, so that the characteristics of efficient clamping, of easy transit between the weft thread presenter and the supply grippers, as well as quick transit between carrying gripper and drawing gripper are still maintained.

To this end, the present invention contemplates a carrying gripper wherein the clamping device comprises part of the thread guiding element or jaw of the gripper. Consequently, the carrying gripper enjoys the advantage that it does not have a separate clamping device—with special parts—and can thus be made lighter in weight than prior art carrying grippers.

Another advantage of the present invention and which contributes to the weight reduction of the carrying gripper is the fact that the hingepoint between the moving parts of the clamping device may be located nearer to the front end of the gripper, whereby the gripper may have a shorter and lighter body.

An additional advantage of the invention is related to the fact that the gripper hinge may extend over the full height or width of the gripper. In this way, a strong and wide hingepoint is obtained, whereby the point at which compressive force for opening the clamping device is always located between the ends of the hinge in such a way that no torsion is applied to the hinge.

The present invention also concerns a carrying gripper for a gripper weaving loom, characterized by the fact that it has a thread guiding element which moves towards the gripper body, whereby the clamping force for the thread results from the cooperation of a moving thread guiding element with the gripper body proper. The moving thread guiding element is preferably comprised of the gripper jaw that projects most fowardly of the gripper. Several control arrangements are contemplated for adjusting the thread clamping force. These controls are mounted preferably on the gripper body.

The carrying gripper in accordance with the present invention is arranged such that, in the event of a collision between the weft carrying gripper and a weft drawing gripper at the moment of weft thread passing over, the clamping arrangement of the weft carrying gripper is arranged such that it will tend to be kept closed to avoid losing the weft thread.

BRIEF DESCRIPTION OF THE DRAWINGS

Preferred embodiments of the invention are described below and illustrated in the drawings, wherein:

FIG. 3 is a top view of another embodiment of the gripper;

DETAILED DESCRIPTION OF THE PREFERRED EMBODIMENTS

Figure 1:
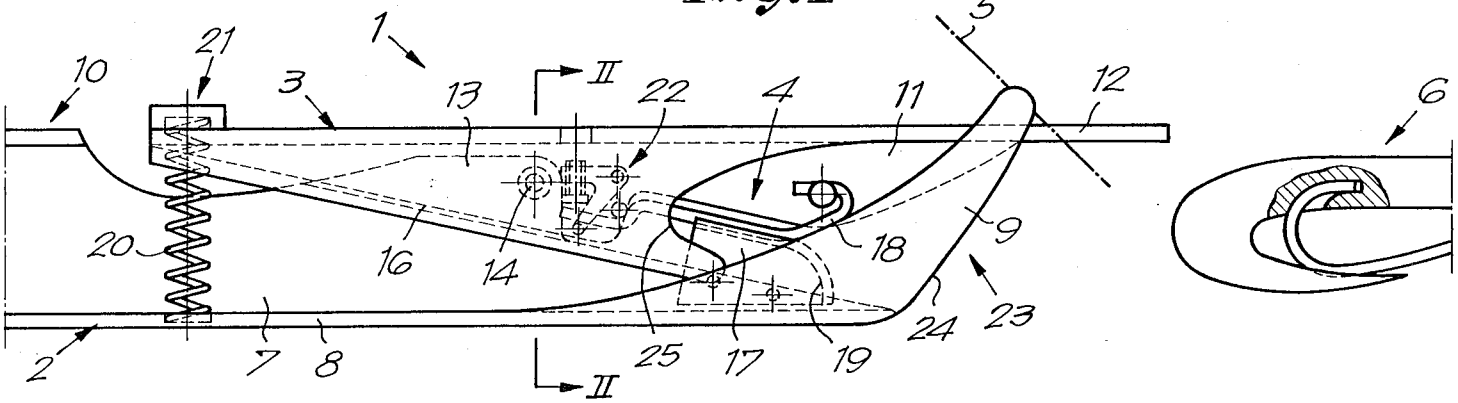
FIG. 1 is a top view of a weft carrying gripper made according to the invention.

As illustrated in the drawings, the weft carrying gripper embodying the invention essentially comprises a gripper body portion 2 equipped with a moveable thread guide portion or 3 (hereinater referred to as "thread guide" 3) comprising a gripper jaw at the forward most end of the gripper (the word "forward" means in the direction of weft feed motion). The clamping device 4 used for clamping the presented weft thread 5 includes the movable thread guide 3, the gripper body portion 2 and a wire spring clamp 18 that cooperates with an anvil 17 (in the FIG. 1 embodiment shown).

The gripper 1 according to FIG. 1 is designed to engage a horizontally presented weft thread 5 and to insert it into the shed, following which the thread is taken over by the drawing gripper 6 to complete its insertion in the shed.

The relatively fixed gripper body portion 2 (hereinafter referred to simply as "body" 2) is mainly composed of a bottom plate 7, a side plate 8 and a top plate 9. The gripper body 2 is connected to a movable tape or strap at its rearward end 10 (not illustrated) either directly or indirectly by the use of an intermediate element.

The moveable thread guide 3 essentially is U-shaped in cross section and also includes a bottom plate 11, a side plate 12 and a top plate 13. This thread guide is pivotally fastened to the gripper body by hinge 14 in such a way that it is able to work as a lever. To this end, the bottom plates respectively 7 and 11 are connected to each other by means of the hinge 14 composed, for instance, of a bolt or a similar element. In order to provide a smooth bottom side 15, one of the bottom plates, in the present case the bottom plate 7 of the gripper body 2, has an offset area 16 where the other bottom plate 11 is secured.

The clamping device 4 comprises an anvil 17 that is fastened to the bottom plate 7 of the gripper body 2 and a wire spring 18 that is fastened against the bottom plate 11 of the thread guide 3. The spring 18 cooperates with a V-shaped notch 19 in the anvil 17. The clamping effect of the device 4 is achieved by the lever action of the thread guide 3 under the influence of a spring 20, in the present case a compression spring acting between the end of the thread guide 3 extending rearwardly and the side plate 8 of the gripper body 2. The rotatable thread guide is also equipped with a cam engaging follower 21 that is composed, in the embodiment of FIG. 1 of a protruding part like a welded piece which can be actuated during the movement of the gripper or not actuated by means of a cam that is not illustrated in the figures.

The clamping device 4 includes preferably tension control means 22 in order to adjust and/or control the pre-stress in the wire spring 18. Such control devices are already known and have been described, for example, in the Belgian Patent No. 902141 mentioned previously. As described in the Belgian Patent, the anvil 17 also can be provided with an adjustment fixture for controlling the clamping force.

The end 23 of gripper 1 located forwardmost is provided with a shape to enhance proper guidance of the horizontally presented weft thread 5 towards the clamp 4.

The operation of the carrying gripper 1 of FIG. 1 is as follows. When the gripper engages horizontally presented thread 5, the thread moves between the top edge of the side plate 12 of the thread guide 3 and the bottom side of the top plate 9 of gripper body 2. The thread 5 is then guided along the edge 24 of the latter top plate 9 into the clamping device 4. While the gripper 1 is moving through the shed, the thread 5 extends from the clamping device 4 in the rearward direction, and the location of the thread 5 on guide 3 is determined by a cut-out 25 in the top plate 13 of the thread guide 3.

When the weft thread 5 is engaged by the gripper, the advantage results in that, since the thread 5 is guided over the side plate 12, the rotatable thread guide 3 tends to be urged by the thread in such a way that the clamping device 4 tends to open. Also, when the thread 5 is taken over by the drawing gripper 6, another advantage occurs in that the thread is pulled downwards on the anvil 17 without working against the clamping force produced by the clamping device 4.

Figure 4:
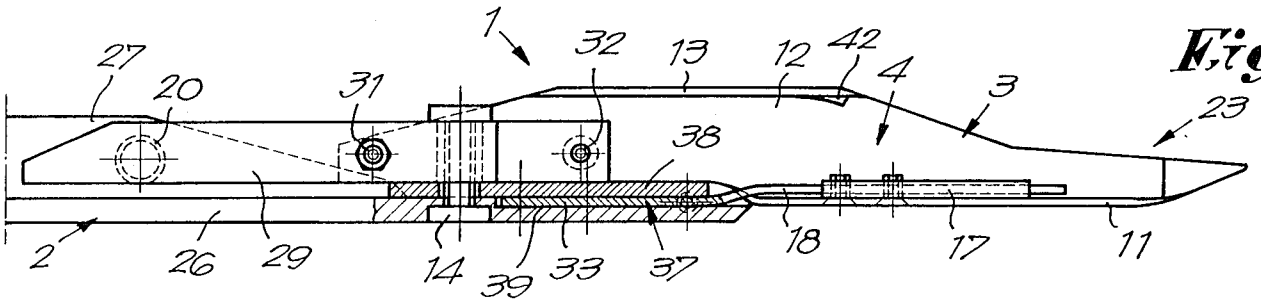
FIG. 4 is a side view of a detail taken along arrow $F_4$ of FIG. 3.

FIGS. 3 and 4 illustrate an alternative arrangement of a supply gripper 1 useful in the case of vertically or skewed upwardly presented weft thread 5. The gripper body 2 in this embodiment mainly comprises a bottom plate 26. A plate 27 may possibly be mounted perpendicular to the former in order to achieve some reinforcement, which plate may have a seat 28 wherein the aforesaid spring 20 can be anchored.

In this embodiment, the thread guide 3 also comprises a lever that is rotatably mounted on transverse hinge 14, the lever including a bottom plate 11, a side plate 12 and a top plate 13. The rear porton 29 of the longitudinally extending lever arm is connected to the side plate 12 by means of a screw elements 31 and 32.

The clamping device 4 differs from the embodiment of FIG. 1 in that the anvil 17 is connected to the moveable thread guide 3 while the spring 18 is secured on the relatively fixed gripper body 2. The anvil 17 in this case is fastened against the bottom plate of the thread guide 3, while the spring 18 is fastened, for instance, by means of its flat end 33 by a screw 34 engaging the bottom plate 26. The spring 18 can also be equipped with tension control means, like adjustment screws 35 and 36, in order to adjust, respectively, the position of the spring 18 and the pre-stress in the spring. The spring 18 and anvil 17 may be referred to as clamping portions of the guide 3 and body 2 for convenience. The fact that the control means 35 and 36 are secured on the fixed gripper body 2 results in a stable control of the clamping device. As such control means have already been adequately described in the Belgian Patent No. 902,141, they are schematically illustrated in FIG. 3 for reasons for simplicity.

As illustrated in the partial cros s section view of FIG. 4, the part 37 of spring 18 located against the bottom plate 26 as well as the control means for this spring can be equipped with a protective shield 38. Thus, in the case of accidental impact of the gripper 6 against the fastening area of the spring 18 and/or its tension control means, the risk of deformation of the spring or of damage to the system is avoided. The part 37 of the spring 18 will be preferably mounted in a cut-out 39 in the bottom plate 26. The shield 38 can be a simple cover plate, for example.

The embodiment described hereabove has the advantage that the gripper body 2 can have essentially the same transverse cross section size as the tape and could also be a part of it (i.e., an extension). In an alternate arrangement, the hinge of the moveable thread guide 3 and the aforesaid cut-out 39 for the spring end 33 could be located in the end of the tape itself.

This embodiment also has the advantage that the hinge 14 of the thread guide 3 may be very strong and broad. The size of the hinge is indeed only limited by the size of the gripper itself since it extends across the gripper width or height.

Accordingly to an alternative solution which is not illustrated in the figures, this hinge can also be mounted outside of the projected path of the drawing gripper 6, whereby, in the event of loosening of gripper 6, the latter can move simply along the gripper 1 without changing any part of it.

Compared with the first described embodiment, the gripper 1 of FIGS. 3 and 4 has the advantage that, if the drawing gripper 6 collides with the thread guide 3 due to undesirable conditions, thereby tending to rock guide counterclockwise relative to hinge 14, the spring 18 and the anvil 17 of clamping device 4 will tend to be kept closed and the weft thread 5 will not be lost.

Moreover, in the embodiment of FIG. 3, it is unimportant for the correct overtake of the weft thread 5 from the clamping device 4, to establish along which side the opening 4 of the drawing gripper the thread is located in relationship with the thread guide 3. Because the carrying gripper is completely open on one side 41 and half open on its top side, the advantage is achieved in that the drawing gripper 6, if it is mounted as illustrated in FIG. 3, is not limited in size by the space made available in the carrying gripper 1 for its passage.

When the gripper 1 is moved along the shed, the engaged position of the thread 5 is determined in this case by a recess 42 in the top plate 13 (FIGS. 3 and 4).

Figure 6:
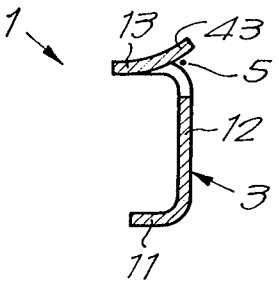
FIG. 6 is a cross section along line VI—VI of FIG. 5.
Figure 5:
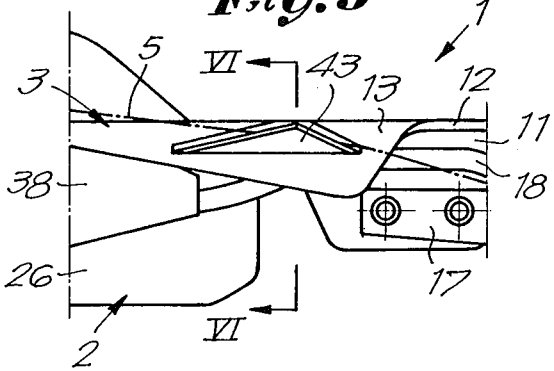
FIG. 5 shows an alternative construction of the detail indicated by $F_5$ in FIG. 3.
Figure 2:
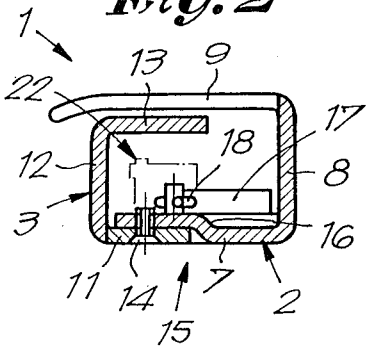
FIG. 2 is cross section taken along line II—II of FIG. 1.
Figure 5:
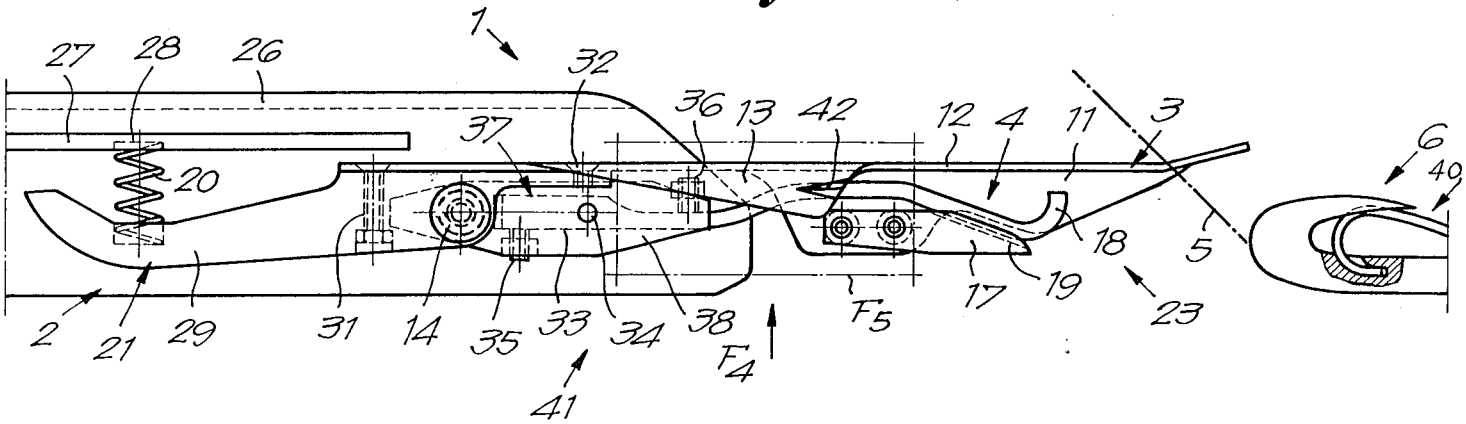
Figure 8:
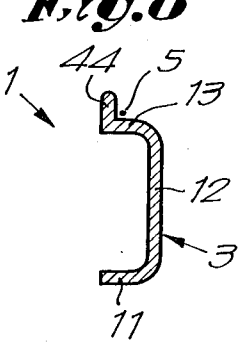
FIG. 7 and 8 illustrate another alternative embodiment of the gripper.
Figure 7:
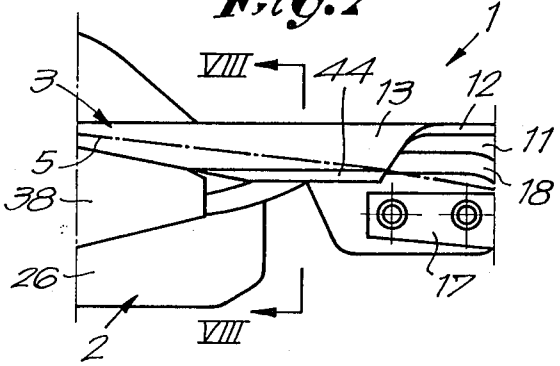
Figure 9:
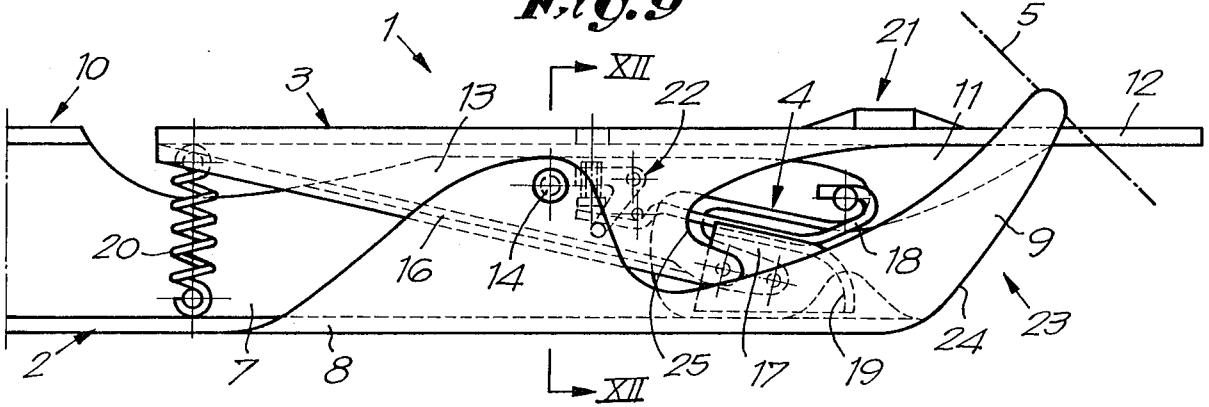
FIG. 9 is a top view of still another embodiment of the carrying gripper.
Figure 10:
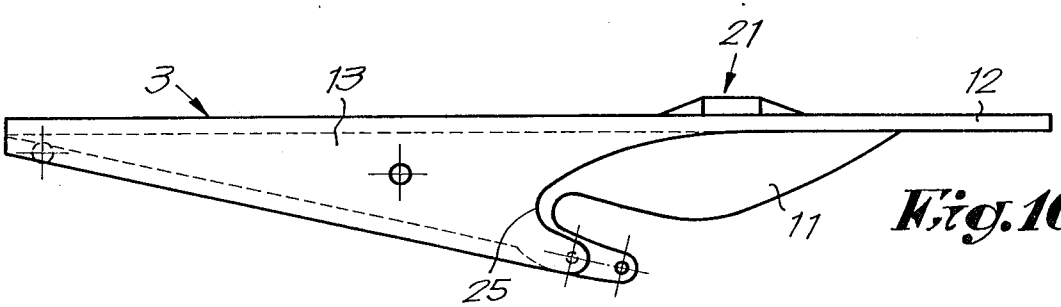
FIG. 10 shows the moveable thread guiding element of the gripper of FIG. 9.
Figure 11:
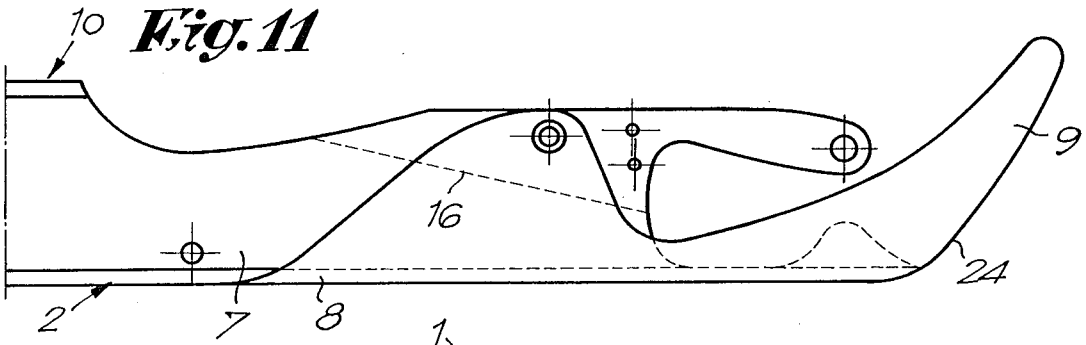
FIG. 11 shows the fixed body portion of the gripper of FIG. 9.
Figure 12:
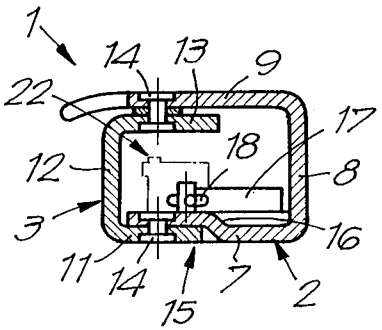
FIG. 12 is a cross section taken along line XII—XII of FIG. 9.

According to still another alternative embodiment illustrated in FIGS. 5 and 6, the aforesaid cut-out 25 or the recess 42 and the top plate 13 of the thread guide 3may be substituted by a lip element pressed out from the top plate 13 and having the shape of a triangular lip 43. Still another alternative solution is illustrated in FIGS. 7 and 8, wherein the location of the clamped thread in relationship with the gripper 1 during its movement in the shed is determined bu the edge 44 of the top plate 13 which is bent upwardly.

FIGS. 9–12 illustrate another embodiment of the carrying gripper 1, wherein the operating principle mainly corresponds with the embodiment according to FIG. 3, while the overall design is derived from the embodiment according to FIG. 1. This weft carrying gripper 1 is designed for application with horizontal presentation of the weft thread.

In this embodiment, the wire spring 18 and the tension control means 22 are also fastened to the fixed gripper body 2, while the anvil 17 is mounted on the moveable thread guide 3. The spring 20 consequently is a tension spring.

The top plate 9 in this embodiment is designed in such a way that the hinge 14 comprises a spaced connection on the top side as well a on the bottom side of the gripper 1 respectively between the bottom plates 7 and 11 and the top plates 9 and 13. As the hinge point 13 really extends over the full height of the gripper, however, no twisting can occur when the compression point 21 is actuated. The hinge point 14 can also have a continuous profile, for example, by using a shaft extending in a cross-direction through the gripper 1.

When the thread guide 3 is pushed open at the moment that the thread 5 engages the gripper 1, for instance, by pushing with a cam (not illustrated) on the opening pressure point 21, it is possible with this latter embodiment to increase the size of the opening between the side plate 12 and the top plate 9, whereby the thread 5 can more easily penetrate into the gripper. In this way, for the same opening, it is possible to achieve a better protection of the end 9 towards the warp threads because the top of the top plate 9 can be taken lower relative to the side plate 12.

Quite obviously, stops which are not illustrated in the figures can also be used in order to limit the movement of the rotatable thread guide 3 if the wire spring 18 or the spring 20 should loosen or break in order to avoid movement of the thread guide 3 into contact with the warp threads.

The present invention is by no means limited to the embodiments described by way of example and illustrated in the figures which are exemplary only. The gripper could be constructed with various different shapes and sizes without departing from the scope of the invention.

We claim:

1. A weft thread carrying gripper for a gripper weaving loom including a cooperating weft drawing gripper that receives each inserted weft thread from the weft thread carrying gripper at a moment of passing over when the grippers converge in overlapping relationship from opposite sides of the loom, said weft carrying gripper comprising a body portion; a thread guide portion pivotally secured to the body portion for movement about a pivot axis intersecting the body portion, said thread guide portion including a guide clamp forward of the pivot axis in the direction of weft insertion; a body clamp secured to the body portion; means for resiliently biasing the guide clamp into contact with the body clamp; said body and guide portions of said weft carrying gripper arranged so that during operation of the loom, any colliding contact between the carrying and drawing grippers at the moment of thread passing over displaces the guide clamp in a direction tending to increase the clamping force between the body and guide portions.

2. A weft thread carrying gripper as claimed in claim 1, wherein said guide clamp comprises a clamping anvil having a clamping surface; and wherein said body clamp comprises a wire spring having a free end area extending towards and adjacent the anvil clamping surface.

3. A weft thread carrying gripper as claimed in claim 1 or 2 said thread guide portion comprising a bottom wall extending traversely of the pivot axis of the thread guiding element, a side wall extending parallel to the pivot axis and an abbreviated top wall extending parallel to the bottom wall but having less width than the bottom wall, whereby an open-sided passageway is provided for receiving a converging drawing gripper during weft insertion.

4. A weft thread carrying gripper as claimed in claim 3, wherein said anvil is carried by the bottom wall and said clamping wire spring extends parallel to and closely adjacent said bottom wall.

5. A weft thread carrying gripper as claimed in claim 3, said top wall including a thread engaging hook feature for locating the position of the weft thread after it is clamped in the gripper during operation of the loom.

6. A weft thread carrying gripper as claimed in claim 3, wherein said thread guide portion is secured to said body portion by a hinge pin extending acros the entire transverse dimension of the thread guide portion.

7. The weft thread carrying gripper as claimed in claim 3, wherein said thread guide porton is secured to said body portion by a hinge pin assembly arranged to support the thread guide portion relative to the body portion across the entire transverse dimention of the thread guide portion.

8. A weft thread carrying gripper as claimed in claim 3, said clamping wire spring including a flattened end portion opposite its free end area, said spring fixedly secured to said body portion at said flattened area; and a protective shield covering said flattened end area.

9. A weft thread carrying gripper as claimed in claim 3, said body portion having a forward end area defined solely by a bottom wall extending parallel to the bottom wall of the thread guide portions and rearwardly of the bottom wall of the thread guide portion relative to the weft insertion direction of motion of the thread guide portion and means for anchoring said means for resiliently biasing the thread guide portion and its associated anvil against the clamping spring.

* * * * *